United States Patent [19]

Reck

[11] 4,171,134

[45] Oct. 16, 1979

[54] GOLF GAME

[76] Inventor: Ray G. Reck, 16 Parakeet Hill, Pontiac, Mich. 48055

[21] Appl. No.: 920,240

[22] Filed: Jun. 29, 1978

[51] Int. Cl.[2] ..... A63B 69/36

[52] U.S. Cl. ..... 273/181 R; 273/178 R; 273/105 A

[58] Field of Search ..... 273/181 A, 181 R, 177 R, 273/180, 176 B, 105 A

[56] References Cited

U.S. PATENT DOCUMENTS

| | | | |
|---|---|---|---|
| 1,656,740 | 1/1928 | Kurtz | 273/180 |
| 2,121,270 | 6/1938 | Streich | 273/180 |
| 2,849,238 | 8/1958 | Eldredge | 273/177 R |
| 3,490,769 | 1/1970 | Torbett | 273/181 R |

FOREIGN PATENT DOCUMENTS

| | | | |
|---|---|---|---|
| 490717 | 2/1953 | Canada | 273/181 R |

*Primary Examiner*—George J. Marlo
*Attorney, Agent, or Firm*—Gifford, Chandler, VanOphem, Sheridan & Sprinkle

[57] ABSTRACT

A simple, inexpensive and yet totaly enjoyable golf game is provided for use outdoors. The game comprises a golf flag assembly insertable into a natural ground surface and at a distance spaced from a tee area. A first annulus is positioned on the ground around the golf flag assembly and defines a first target area within its inner periphery. A second annulus, having a diameter greater than the first annulus is in turn positioned on the ground surface and around the first annulus and defines a second target area between the first and second annulus. A hollow and perforated practice golf ball is then struck with a standard golf club from the tee area and towards the golf flag assembly. The player's score is determined by the numer of strokes necessary to hit the practice golf ball into either the first or second target area plus a predetermined number of strokes for the target area into which the practice ball lands. This predetermined number of strokes is larger for the second target area than for the first. Each annulus is constructed from one or more pieces of tubing, the ends of which may be detachably joined by a resilient double C-shaped clamp. Centrally of the first annulus, a putting cup is staked to the ground by a flag assembly.

6 Claims, 4 Drawing Figures

GOLF GAME

BACKGROUND OF THE INVENTION

I. Field of the Invention

The present invention relates generally to games and amusement devices and, more particularly, to a golf game.

II. Description of the Prior Art

All of these previously known golf games, however, suffer from a number of common disadvantages. First a number of previously known golf games are expensive in construction and, thus, financially impractical for all but the most wealthy and ardent golfers.

A still further disadvantage of many of these previously known golf games is that they are large and bulky in construction and, thus, require a great deal of storage when disassembled. Moreover, assembly of these previously known golf games is not only complex but also time consuming.

A still further disadvantage of these previously known golf games is that such golf games do not present an accurate representation of the actual or full scale game of golf. Consequently, these previously known golf games have proven inadequate as golf teaching devices or aids.

SUMMARY OF THE PRESENT INVENTION

The present invention, however, overcomes these above mentioned disadvantages of the previously known golf game by providing a simple, inexpensive and easily assembled golf game and which requires little storage space when disassembled. Moreover, the golf game according to the present invention is an accurate, albeit scaled down, representation of the actual full scale game of golf and thus can be used as a valuable teaching aid.

In brief, the golf game apparatus of the present invention includes a golf flag assembly which is inserted into a natural ground surface at a position spaced from a tee off area. The actual distance between the tee off area and the golf flag assembly will vary whether the game apparatus is to be representative of a par 3, par 4 or par 5 golf hole.

A first annulus is positioned on the ground surface and around the golf flag assembly thus forming a first target area within its inner periphery. A second annulus, larger in diameter than the first annulus, is then positioned around the second annulus and defines a second target area between the outer periphery of the first annulus and the inner periphery of the second annulus.

A hollow and perforated practice golf ball, sometimes called a whiffle ball, is then hit from the tee off area and toward the golf flag assembly by a standard golf club. A player's score is determined by the number of golf strokes necessary to drive the practice ball from the tee off area and into one of the target areas plus a predetermined number of strokes assigned to each target area. For example, the first target area can be representative of a single putting stroke whereas the second target area is representative of two putting strokes. As in the actual game of golf, a low score is preferable.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
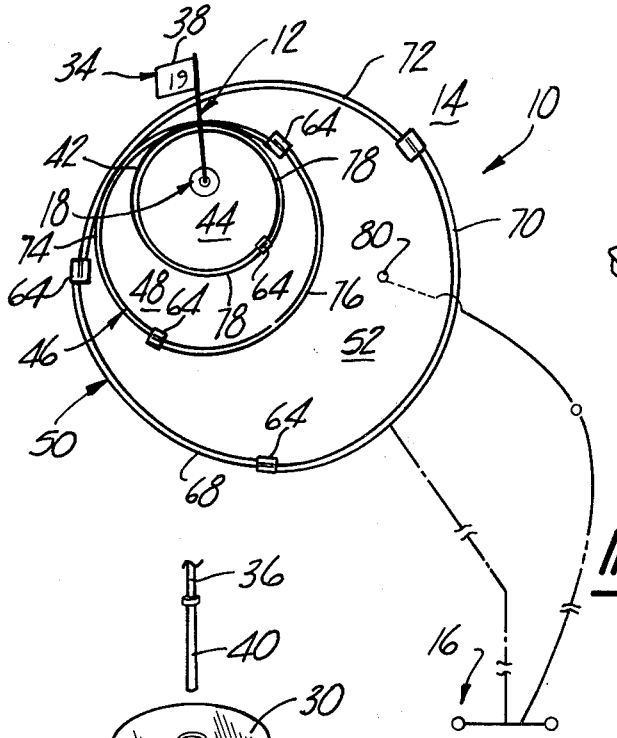
FIG. 1 is a partial diagrammatic top plan view illustrating the golf game of the present invention.

With reference first to FIG. 1, the golf game 10 of the present invention is thereshown iagrammatically as comprising a pin assembly 12 secured to a ground support surface 14 in a manner which will subsequently be described in greater detail. A tee off area 16 is also arbitrarily marked on the ground surface 14 at a position spaced from the golf flag assembly 12.

Figure 3:
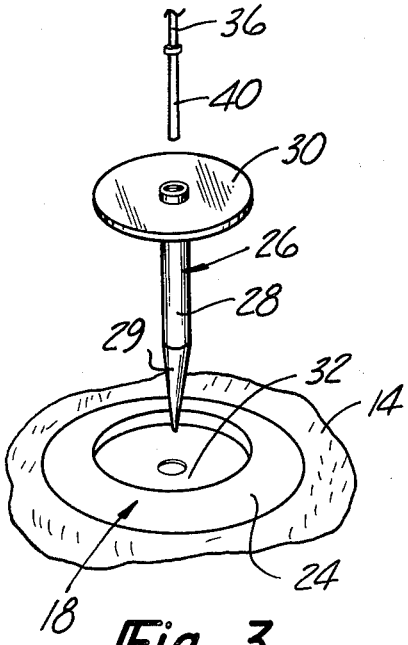
FIG. 3 is a fragmentary perspective view showing another part of the golf game of the present invention.
Figure 4:
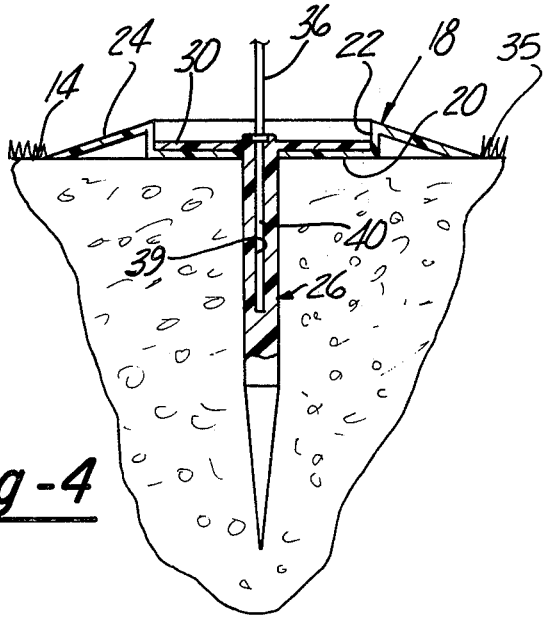
FIG. 4 is a fragmentary sectional view of one portion of the golf game of the present invention.

The golf flag assembly 12 is best illustrated in FIGS. 1, 3 and 4 and includes a circular cup 18 having a bottom surface 20 which rests on the ground 14 and a central cylindrical chamber 22. An annular ramp 24 about the outer periphery of the chamber 22 slopes downwardly from the chamber 22 and toward the ground surface 14 for a reason to be subsequently described.

A stake member 26 comprising an elongated shank 28 pointed at one end 29 and a disc 30 coaxially secured to its other end is also provided. The pointed end 29 of the shank 28 is inserted through a central hole 32 in the cup 18 and into the ground surface 14. The disc 30 is dimensioned to fit within the chamber 22, as shown in FIG. 4, and in doing so secures both the stake member 26 and cup 18 securely to the ground surface 14. Moreover, the overall height of the cup 18 is less than the normal height of grass 35 on the ground surface 14 so that the blades of a lawn mower wound not strike the cup 18 if the lawn mower were driven over the cup 18. The stake member 26 with its upper disc 30 further minimizes this potential safety hazard since the disc 30 abuts against the bottom of the cup 18 and firmly, but removably, holds the cup 18 close to the ground 14.

A flag assembly 34 is also provided and includes an elongated flag pole 36 having a flag 38 secured to its upper end. The lower end 40 of the flag pole 36 is insertable into a central axial bore 39 in the upper end of the shank 28 as shown in FIG. 4. The flag assembly 34 is easily removable from or inserted into the shank 28 and may also include breakdown means to shorten the length of the flag pole 36 for storage.

Figure 2:
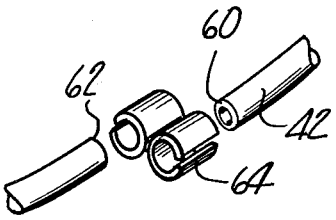
FIG. 2 is a fragmentary perspective view showing one part of the golf game of the present invention.

With reference now to FIGS. 1 and 2, a first annulus 42 is positioned on the ground surface 14 around the pin 12 and thus, defines a first target area 44 within its inner periphery. Similarly, a second annulus 46 having a diameter greater than the first annulus 42 is positioned around the first annulus 42 and defines a second target area 48 between its inner periphery and the outer periphery of the first annulus 42. Likewise, a third annulus 50 having a diameter larger than the second annulus 46 can also be positioned around the second annulus 46 and defines a third target area 52 between its inner periphery and the outer periphery of the second annulus 46. Each annulus 42, 46 and 50 is preferably differently colored for simple differentiation between the annuli 42, 46 and 50 from a distance.

With the exception of the size difference and color between the annuli 42, 46 and 50, each annulus is substantially identical so that only one annulus will be described in detail, it being understood that the same description applies to the other annuli. The annulus 42 is preferably constructed from a resilient plastic tubing or one or more lengths. The ends 60 and 62 of the tubing are brought together in a side by side relationship, as best shown in FIG. 2 and detachably secured together by a resilient double C-shaped clamp 64. The clamp 64 is preferably made of plastic and enables the overall length of the annulus 42, 46 or 50 to be simply adjusted since the clamp 64 can engage any desired portion along the tubing.

Preferably each annulus 42, 46 and 50 is constructed from substantially equal lengths of time. Consequently, the largest annulus 50 will be constructed from three lengths of tubing 68, 70 and 72 with one wooden dowel 64 being positioned between each length of tubing. Similarly, the second largest annulus 46 is constructed from two lengths of tubing 74 and 76 secured together by two dowels 64 while the first annulus 42 is constructed from a single length of tubing 78 secured together by one dowel 64.

The golf game 10 according to the present invention is played with a golf practice ball 80 (FIG. 1) which is hollow, perforated and typically constructed of plastic. Such practice golf balls are often known as whiffle balls.

The component parts of the golf game apparatus 10 of the present invention having been described, the game is played as follows:

The practice golf ball 80 is hit from the tee area 16 and toward the pin assembly 12 by a standard or conventional golf club which can be either an iron or a wood. If the game is set up as a par 3 golf hole, the distance between the tee off area 16 and the pin assembly 12 is sufficiently short to enable a skilled golfer to drive the practice ball 80 the distance necessary to reach the pin assembly 12 with a single stroke. Conversely, if the golf game is set up as a part 5 or par 4 golf hole, the distance between the tee off area 16 and the pin assembly 12 is enlarged to enable a skilled golfer to reach the pin assembly 12 from the tee off area 16 in two, or three golf strokes, respectively.

If the player hits the practice ball into the first target area 44 from outside the third target area, the player automatically adds a single putting stroke to the number of strokes necessary to reach the first target area 44 since the target area 44 is representative of the distance sufficiently short that the golfer would normally sink his golf ball with a single putt. Similarly, if the player hits the practice ball 80 from outside the third target area 52 and into the second target 48 the player automatically adds two strokes to the number of strokes necessary to hit the practice ball 80 into the second target area 48. The second target area 48 is sufficiently spaced from the flag assembly 34 so that the player would normally require two putts in order to sink the golf ball. Similarly, the player adds three to his score strokes if he lands in the third target area 52.

The practice golf ball 80 has insufficient mass for proper putting but this is not detrimental to the golf game 10 of the present invention in that most ground surfaces that are found in parks, lawns and the like are insufficiently smooth to allow proper putting. However, in the event that the ground surface 14 is sufficiently smooth and properly covered with grass, the practice golf ball 80 can be replaced with a normal golf ball within one of the target areas 44, 48 and 52 and putted towards and into the cup 18 and with the flag pole 36 removed. For example, if the player is able to sink the golf ball from the third target area 52 in one or two putts his overall score is accordingly reduced. However, in no event would the player be required to add more than three strokes to his score when putting from the third target area 52. Similarly, if the player is able to sink a normal golf ball from the second target area 48 in a single putt, he is permitted to reduce his score by a single stroke.

From the foregoing it can be seen that the golf game 10 of the present invention provides a novel, simple and easily assembled game which is also inexpensive to manufacture. Moreover, since the tubing sections of each annulus 42, 46 and 50 are substantially the same length, the individual sections can be detached from each other, straightened and easily stored with a minimum of required storage space. Moreover, the golf game apparatus provides a valuable teaching aid for the game of golf since standard golf clubs are used but with a minimization of required playing area due to the use of the whiffle practice golf ball 80.

In addition, since the height of the cup 18 is less than the normal height of the grass, the cup 18 and the stake member 26 can be left in the ground without creating a safety hazard should a lawn mower be driven over the cup 18.

Having described my invention, however, many modifications thereto will become apparent to those skilled in the art to which it pertains without deviation from the spirit of the invention as defined by the scope of the appended claims.

I claim:

1. A golf game apparatus for use on a natural ground surface comprising:

a golf flag assembly insertable into the ground surface;

a first annulus positioned on said ground surface around said golf flag assembly and defining a first target area within its inner periphery;

a second annulus having a diameter larger than the diameter of the first annulus, said second annulus being positioned on said ground surface around said first annulus and defining a second target area between said first annulus and said second annulus;

a third annulus having a diameter larger than the diameter of the second annulus, said third annulus being positioned on said ground surface around said second annulus and defining a third target area between said third and said second annulus;

wherein each annulus comprises at least one elongated tubular cylindrical member, the ends of said tubular cylindrical member being brought together in an end to end relationship, and means for detachably joining the ends of the tubular cylindrical member together, wherein said last mentioned means comprises a double C-shaped clamp adapted to resiliently engage the outer periphery of the tubular cylindrical member;

a substantially hollow and perforated golf practice ball;

wherein said perforated ball is hit with a standard golf club toward the golfing assembly; and wherein a player's score is determined by the number of strokes necessary to hit said practice ball into either said first, second or third target areas plus a predetermined number of strokes for the target area into which the practice ball lands, said predetermined number of strokes being larger for said second target area than said first target area, and said predetermined number of strokes for said third target area being larger than said second target area.

2. The invention as defined in claim 1, wherein said clamp is made of plastic.

3. The invention as defined in claim 1 wherein the engagement of said C-shaped clamp around the outer periphery of the tubular cylindrical member is longitudinally adjustable along the tubular cylindrical member.

4. A golf game apparatus for use on a natural ground surface comprising:

a golf flag assembly insertable into the ground surface, said golf flag assembly comprising a circular cup defining a central cylindrical chamber, a stake member inserted through the cup member and into the ground surface for holding the cup member to the ground and a flag pole detachably connected to the stake member;

a first annulus positioned on said ground surface around said golf flag assembly and defining a first target area within its inner periphery;

a second annulus having a diameter larger than the diameter of the first annulus, said second annulus being positioned on said ground surface around said first annulus and defining a second target area between said first annulus and said second annulus;

a substantially hollow and perforated golf practice ball;

wherein said perforated ball is hit with a standard golf club toward the golfing assembly from a tee area spaced from the golf flag assembly; and wherein a player's score is determined by the number of strokes necessary to hit said practice ball into either said first or second target areas plus a predetermined number of strokes for the target area plus a predetermined number of strokes for the target area into which the practice ball lands, said predetermined number of strokes being larger for said second target area than said first target area.

5. The invention as defined in claim 4, wherein the height of the cup is less than the height of grass on the ground support surface whereby a lawn mower can pass over the cup member without striking the cup.

6. A golf game apparatus for use on a natural ground surface comprising:

a golf flag assembly insertable into the ground surface;

a first annulus positioned on said ground surface around said golf flag assembly and defining a first target area within its inner periphery;

a second annulus having a diameter larger than the diameter of the first annulus, said second annulus being positioned on said ground surface around said first annulus and defining a second target area between said first annulus and said second annulus;

a third annulus having a diameter larger than the diameter of the second annulus, said third annulus being positioned on said ground surface around said second annulus and defining a third target area between said third and said second annulus;

wherein each annulus comprises at least one elongated tubular cylindrical member, the ends of said tubular cylindrical member being brought together in an end to end relationship, and means for detachably joining the ends of the tubular cylindrical member together, said first annulus being constructed of a single tubular member, said second annulus being constructed of two tubular members, and said third annulus being constructed of three tubular members, said tubular members being substantially of equal length;

a substantially hollow and perforated golf practice ball;

wherein said perforated ball is hit with a standard golf club toward the golfing assembly from a tee area spaced from the golf flag assembly; and wherein a player's score is determined by the number of strokes necessary to hit said practice ball into either said first, second or third target area plus a predetermined number of strokes for the target area into which the practice ball lands, said predetermined number of strokes being larger for said second target area than said first target area, and said predetermined number of strokes for said third target area being larger than said second target area.

* * * * *

UNITED STATES PATENT AND TRADEMARK OFFICE

CERTIFICATE OF CORRECTION

PATENT NO. : 4,171,134

DATED : October 16, 1979

INVENTOR(S) : Ray G. Reck

It is certified that error appears in the above-identified patent and that said Letters Patent are hereby corrected as shown below:

In the Abstract, line 1, delete "totaly" and insert --totally-- therefor;

Column 2, line 16, delete "iagrammatically" and insert --diagrammatically-- therefor;

Column 3, line 16, delete "time" and insert --tubing-- therefor;

Signed and Sealed this

*Fifth* Day of *February 1980*

[SEAL]

*Attest:*

SIDNEY A. DIAMOND

*Attesting Officer*

*Commissioner of Patents and Trademarks*